United States Patent [19]

Annen et al.

[11] 4,436,521

[45] Mar. 13, 1984

[54] PROCESS FOR PRODUCING DYED AND ANTI-SHRINK TREATED WOOL

[75] Inventors: Oskar Annen, Aesch; Hermann Egli, Basel; Karl Zesiger, Allschwil, all of Switzerland

[73] Assignee: Sandoz Ltd., Basel, Switzerland

[21] Appl. No.: 382,681

[22] Filed: May 27, 1982

Related U.S. Application Data

[63] Continuation of Ser. No. 178,124, Aug. 14, 1980, abandoned, which is a continuation of Ser. No. 103,272, Dec. 13, 1979, abandoned.

[30] Foreign Application Priority Data

Oct. 18, 1979 [CH] Switzerland ..... 9366/79

[51] Int. Cl.[3] ..... D06P 1/56; D06P 3/16; D06P 5/00; D06P 5/02

[52] U.S. Cl. ..... 8/493; 8/495; 8/556; 8/606

[58] Field of Search ..... 8/493, 495, 442, 556, 8/606

[56] References Cited

U.S. PATENT DOCUMENTS

| | | | |
|---|---|---|---|
| 2,004,476 | 6/1935 | Barz et al. | 8/606 |
| 2,250,930 | 7/1941 | Evans et al. | 8/606 |
| 2,322,333 | 6/1943 | Widner et al. | 8/556 |
| 2,431,562 | 11/1947 | Jacoby | 8/496 |
| 2,723,178 | 11/1955 | Mooradian et al. | 8/606 |
| 2,934,523 | 4/1960 | Albrecht et al. | 8/495 |
| 3,490,859 | 1/1970 | Soiron et al. | 8/549 |
| 3,529,922 | 9/1970 | Berger et al. | 8/604 |
| 3,606,988 | 9/1971 | Walz et al. | 8/560 |

FOREIGN PATENT DOCUMENTS

| | | |
|---|---|---|
| 671704 | 2/1939 | Fed. Rep. of Germany . |
| 2801535 | 7/1978 | Fed. Rep. of Germany . |
| 1006787 | 10/1965 | United Kingdom . |
| 1193294 | 5/1970 | United Kingdom . |
| 1264683 | 2/1972 | United Kingdom . |
| 1553811 | 10/1979 | United Kingdom . |

OTHER PUBLICATIONS

Chemical Abstracts, 92, 78018(f).

*Primary Examiner*—Maria Parrish Tungol
*Attorney, Agent, or Firm*—Gerald D. Sharkin; Richard E. Vila; Thomas C. Doyle

[57] ABSTRACT

The invention relates to a process for the production of anti-shrink treated wool dyeings in which wool is dyed with acid milling or metal complex dyes either before, after or between the steps of an anti-shrink treatment and, after the dyeing or the anti-shrink treatment or one of the steps of the anti-shrink treatment subsequent to the dyeing, is after-treated with a liquor containing a cationic fixing agent and a levelling/retarding agent having affinity for wool dyestuffs, and to a composition usable for such a process.

29 Claims, No Drawings

PROCESS FOR PRODUCING DYED AND ANTI-SHRINK TREATED WOOL

This is a continuation of application Ser. No. 178,124, filed Aug. 14, 1980 and now abandoned, which in turn is a continuation of application Ser. No. 103,272, filed Dec. 13, 1979, now abandoned.

The present invention relates to a process for producing dyed and anti-shrink treated wool, the resulting dyeings having improved wet fastness.

More particularly, the present invention provides a process for the production of dyed and anti-shrink treated wool in which wool is dyed with acid milling or metal complex dyes either before, after or between the steps of an anti-shrink treatment, and after the dyeing or the anti-shrink treatment or one of the steps of the anti-shrink treatment subsequent to the dyeing is after-treated with a liquor containing a cationic fixing agent and a levelling/retarding agent having affinity for wool dyestuffs.

Anti-shrink treatments for wool are known and may be e.g.

- chlorination for example acid chlorination in the presence of a buffer or acid or neutral chlorination with dichloroisocyanuric acid derivatives;
- chlorination followed by a resin treatment for example, acid chlorination followed by treatment from an aqueous solution, with an epichlorohydrin modified polyamide or polyacrylate polymer;
- treatment with resin alone for example, treatment with an aqueous emulsion or organic solvent solution of a polyurethane containing free isocyanate groups, treatment with a resin which is a Bunte salt of a polyether prepared from polypropyleneoxide and glycerol; or treatment with a polydimethylsiloxane based resin; or
- treatment by chlorination under alkaline conditions followed by acid shock treatment.

The process of the present invention is particularly adapted for wool which has been or is to be subjected to those treatments which are applied to wool intended for the IWS "Superwash" level. However, it will be appreciated that where the anti-shrink treatment comprises chlorination, the dyeing and after-treatment should be carried out after chlorination owing to the severe conditions of this treatment.

Suitable cationic fixing agents are those commonly used in paper and textile aftertreatments and include:

(A) addition salts of pre-condensation products of formaldehyde with an amino- or imino-group-containing compound or compounds, for example urea, thiourea, cyanamide, dicyanodiamide, dicyanodiamidine, guanidine, biguanide, biuret, melamine, aliphatic amines, and aromatic amines, examples of such compounds are described in German Pat. No. 671,704 and British Pat. No. 1,193,294;

(B) addition salts of condensation products of chloroparaffins with a polyethyleneimine such as one obtained from ethylene chloride and ammonia;

(C) addition salts of long chain unsaturated fatty acid residue-containing polyamines such as an ammonium salt of oleoyldiethylethylenediamine;

(D) long chain alkyl pyridinium compounds such as salts of cetyl and dodecylpyridinium, and (E) acid-condensation products of a urea derivative with alkanolamines such as ethanolamines.

Preferred cationic fixing agents are those of type A, particularly the condensates of the amino- or imino-group containing compound or compounds and formaldehyde, optionally in the presence of an ammonium donator (e.g. urea or an ammonium salt of a mineral acid capable of splitting off ammonia). More preferred cationic fixing agents are the condensation products of dicyanodiamide and formaldehyde in the presence of ammonium chloride; they may be formed under acid to neutral conditions by heating 7 to 15 parts by weight ammonium chloride, 8 to 25 parts dicyanodiamide with deionised water and reacting the whole with 30 to 40 parts of a 40% formaldehyde solution.

According to the process of the present invention, the wool is dyed with metal complex dyestuffs and acid milling dyestuffs. Preferred acid milling dyes are those having mol. weights of at least 800. The preferred metal complex dyestuffs are those which contain water solubilizing groups such as sulpho, carboxylic acid, sulfonamido and alkylsulphonyl groups, preferably at least one sulpho group. Further preferred metal complex dyestuffs are the 1:2 chromium or cobalt complexes of azo or azomethine dyestuffs, particularly of monoazo or azomethine dyestuffs. When anti-shrink treated wool is dyed with metal complex dyes such as specified, these may contain additionally a fiber-reactive group.

The wool is dyed (or printed) in accordance with known methods, with any of the dyestuffs mentioned above and the dyeing step optionally comprises a subsequent rinsing step.

According to the process of the invention, the dyeing may be effected at any stage, e.g. after or before the anti-shrink treatment, with the proviso that where such comprises a chlorination step the dyeing and aftertreatment are carried out after such chlorination steps, or between the steps of an anti-shrink treatment. The after-treatment of the dyeings may be carried out either directly after the dyeing or after an intermediary anti-shrink treatment (or after one step of the anti-shrink treatment). Preferably, the after-treatment is effected directly after the dyeing. In the case where the anti-shrink treatment comprises chlorination and resin treatment, dyeing and aftertreatment may, for example, be effected after chlorination and before resin treatment or after chlorination and after resin treatment or yet again aftertreatment may be effected simultaneously with the resin treatment in the same bath. However, the wool is preferably first subjected to an anti-shrink treatment and then dyed and aftertreated with a cationic fixing agent and a levelling/retarding agent according to the invention.

The after-treatment may be carried out by known methods for example by padding, spraying, treatment in an aqueous bath or by a continuous dipping process. Preferably the treatment is carried out in an aqueous bath. The bath-treatment time may vary between 5 and 60 minutes, preferably the treatment time is approximately from 20 to 30 minutes. The bath temperature may be between room temperature and 80° C., preferably between 20° and 50° C. The treatment is carried out at a pH from 5 to 9, preferably 7 to 8.

Suitable amounts of cationic fixing agent in the bath-treatment liquor are 0.5 to 6%, preferably 1 to 4%, more preferably 1 to 3%, especially 2% by weight based on the weight of the substrate.

Suitable levelling/retarding agents which can be used in admixture with the cationic fixing agent are known surfactant compounds commonly used as dyeing assistants, e.g. for the dyeing of wool, of polyamide etc. Preferred levelling/retarding agents are those having, in addition to their affinity for wool dyestuff, a cationic or amphoteric character. Examples of cationic agents include addition products of alkylene oxide, e.g. ethylene oxide, propylene oxide, butylene oxide and/or styrene oxide, preferably ethylene oxide, on fatty monoamines or polyamines, fatty acid amido-amines and bis-(2-hydroxy-3-alkoxypropyl)amines, the fatty chain being saturated or unsaturated. Such compounds may optionally be quaternized. More preferred cationic levelling/retarding agents having affinity for wool dyes are ethoxylated fatty amines or polyamines, optionally quaternized, such as stearylamine, behenylamine, oleylamine or oleyl-, cetyl-, stearyl-, benhenyl-aminoethylamine or -propylamine, and quaternized ethoxylated fatty acid amido-amines such as behenamido- or stear-amido-propyl-di-n-butyl-benzyl ammonium chloride. In such compounds, the ethoxylated chain may contain from 5 to 200 ethyleneoxy units.

Preferred amphoteric levelling/retarding agents having affinity for wool dyes include:

- the reaction product of ethoxylated fatty amines or polyamines with hydroxy-ethanesulphonic acid;
- the reaction product of fatty-amino-alkyl-amines or -polyamines or fatty-amido-alkyl-amines or -polyamines with alkylene oxide (e.g. ethylene, propylene and/or butyleneoxide) and a sulphonation agent such as sulphuric acid, sulphuric chlorhydrine or sulphamic acid;
- the ethoxylated reaction product of phenol and styrene;
- polyethyleneglycol dicarboxylic acid ester wherein one acid moiety is a saturated or unsatured fatty chain and the second acid moiety is $(C_{1-3})$alkyl; and
- polyethyleneglycol ether of polycondensates of formaldehyde with phenol derivatives such as octyl-, nonyl- or dodecyl-phenol.

More preferred amphoteric levelling/retarding agents are sulphate salts of condensates of fatty-amino-alkyl-amines of fattyamido-alkyl-amines such as behenylamino- or behenylamido-3-propylamine, tallowamino- or tallowamido-3-propylamine, with propylene and ethylene oxide, preferably with 1 to 100 mols of ethylene oxide and 1 to 200 mols of propylene oxide.

Suitably, the treatment liquor contains 40 to 60% by weight of the levelling/retarding agent based on the cationic fixing agent, preferably 45 to 55%, more preferably 50%.

The present invention further provides an aqueous composition for treating wool dyeings comprising:

- a cationic fixing agent together with 40 to 60% by weight, based on the cationic
- fixing agent, of a levelling/retarding
- agent having affinity for wool dyes, together with at least 25% by weight, preferably 25 to 70% based on the total weight, of water.

Such compositions may contain further additives, e.g. solubilizing agents such as ethyleneglycol, urea, dispersing agents, etc.

The process according to the present invention gives dyeings with improved wet fastnesses, particularly wash and perspiration fastenesses, which improvement remains with repeated washings. Particularly, it increases the choice of shades for machine-washable wool (superwash wool). Further, the light fastness of the dyeings is not adversely affected, and not only is the wet fastness improved but the rubbing fastness which could be adversely affected is maintained at a satisfactory level.

The following Examples further serve to illustrate the invention. In the Examples all parts are by weight and all temperatures in degrees Centigrade.

EXAMPLE 1

100 parts of HERCOSETT shrinkproofed wool (Superwash finish consisting of an acid pre-chlorination followed by an after-treatment of the pre-chlorination wool with a polyamide epichlorhydrin resin) are introduced at 40° in 4000 parts of a dyeing liquor containing:

- 0,8 parts of an aqueous solution containing 30 g/liter of an addition product of ethylene oxide on stearyl-diphenyloxyethyldiethylenetriamine in a mol ratio 100:1, and 20 g/liter hexamethylenetetramine
- 4 parts of ammonium sulphate, and
- 1 part of the dyestuff C.I. Acid Red 399 (dissolved previously under boiling).

The dyeing liquor is brought to boiling point over the course of 30 minutes and left for 60 minutes at boiling temperature. After rinsing the dyed wool is subsequently treated in an aqueous bath, of the following composition:

- 4000 parts of water,
- 2 parts of a commercially available cationic fixing agent based on a condensation product obtained by heating 8 to 25 parts dicyanodiamide with 7 to 15 parts ammonium chloride in 60 parts of deionised water and reacting the whole with 40 parts formaldehyde 40%, as described in German Pat. No. 671,704 Example 2, and
- 1 part of a commercially available levelling/retarding agent based on ethoxylated stearylamine hydrochloride (40 mols ethyleneoxide per mol stearylamine)

for 20 minutes at 25°. The treated wool is then rinsed and dried.

A red dyeing with good wash- and alkaline perspiration-fastness is obtained.

EXAMPLE 2

When shrinkproofed wool is dyed with a liquor containing 3 parts of ammonium sulphate (cristalline) and 2 parts of the dyestuff C.I. Acid Green 106 in 4000 parts of water and subsequently treated in a bath at 25° as described in Example 1, the same results for the wash- and alkaline perspiration fastness are obtained.

EXAMPLE 3

100 parts of shrinkproofed wool are dyed as specified in Example 1, the dyeing liquor containing 2 parts of the dyestuff C.I. Acid Blue 296 instead of C.I. Acid Red 399. The dyed wool is then treated as indicated in Example 1 in an aqueous bath containing 3 parts of the cationic fixing agent and 1.5 parts of the levelling/retarding agent of Example 1. The same good wash- and alkaline perspiration-fastnesses are obtained.

EXAMPLE 4

By following the procedure indicated in Example 1, 2 or 3, but using a commercially available levelling/retarding agent based on sulphated condensation product of behenylamido- or tallowamido-3-propylamine with 10–15 mols propylene oxide and 10–15 mols ethylene oxide, similar good results are obtained.

What we claim is:

1. A process for producing dyed and anti-shrink treated wool which comprises dyeing wool with an acid milling or a metal complex dye either before, after or between the steps of an anti-shrink treatment and after-treating the dyed wool with a liquor containing a mixture of a cationic fixing agent and a levelling/retarding agent having affinity for wool dyestuffs, with the proviso that where the anti-shrink treatment comprises a chlorination step the dyeing and after treatment are carried out after such chlorination step.

2. A process according to claim 1, in which the cationic fixing agent is an addition salt of condensation products of formaldehyde with an amino- or imino-group-containing compound.

3. A process according to claim 2 wherein the after-treatment is effected at a temperature between room temperature and 80° C.

4. A process according to claim 3 wherein the after-treatment is effected at a pH of 5 to 9.

5. A process according to claim 2, in which the cationic fixing agent is a condensation product of dicyanodiamide and formaldehyde in the presence of ammonium chloride.

6. A process according to claim 3, in which the substrate is after-treated with a liquor containing 0.5 to 6% by weight of cationic fixing agent based on the weight of the substrate.

7. A process according to claim 1, in which the levelling/retarding agent having affinity for wool dyestuffs is cationic or amphoteric.

8. A process according to claim 1, in which the levelling/retarding agent is an ethoxylated fatty amine or polyamine optionally quaternized, a quaternized ethoxylated fatty acid amido-amines or a sulphate salt of a condensate of fatty-amino-alkyl-amines or fatty-amido-alkyl-amines with 1 to 200 mols propylene oxide and 1 to 100 mols ethylene oxide.

9. A process according to claim 1, in which the after-treatment liquor contains from 40 to 60% by weight of the levelling/retarding agent based on the cationic fixing agent.

10. A process according to claim 1, in which the substrate is after-treated with an aqueous treatment liquor at a temperature from 20° to 50° C. for 5 to 60 minutes.

11. A process according to claim 1 wherein the anti-shrink treatment comprises a chlorination step.

12. A process according to claim 11 wherein the cationic fixing agent is an addition salt of condensation products of formaldehyde with an amino- or imino-group-containing compound.

13. A process according to claim 12 wherein the aftertreatment is effected at a temperature between room temperature and 80° C.

14. A process according to claim 13 wherein the aftertreatment is effected at a pH of 5 to 9.

15. A process according to claim 1 wherein the anti-shrink treating, dyeing and after-treating of the wool is effected in a sequence other than (1) dyeing, (2) after-treating and (3) anti-shrink treating.

16. A process for the production of dyed and anti-shrink treated wool comprising the following steps:

chlorinating untreated wool, dyeing the chlorinated wool with an acid milling or metal complex dye, and either after-treating the dyed wool with a liquor containing a mixture of a cationic fixing agent and a levelling/retarding agent having affinity for wool dyestuffs, and then resinating to complete the anti-shrink treatment or resinating the dyed wool to complete the anti-shrink treatment and then after-treating with a liquor comprising a mixture of a cationic fixing agent and a levelling/retarding agent having affinity for wool dyestuffs.

17. A process according to claim 16 wherein the cationic fixing agent is an addition salt of condensation products of formaldehyde with an amino- or imino-group-containing compound.

18. A process according to claim 17 wherein the aftertreatment is effected at a temperature between room temperature and 80° C.

19. A process according to claim 18 wherein the aftertreatment is effected at a pH of 5 to 9.

20. A process for the production of dyed and anti-shrink treated wool comprising dyeing anti-shrink treated wool with an acid milling or metal complex dye and directly thereafter treating the substrate with a liquor comprising a mixture of a cationic fixing agent and a levelling/retarding agent having affinity for wool dyestuffs.

21. A process according to claim 20 wherein the cationic fixing agent is an addition salt of condensation products of formaldehyde with an amino- or imino-group-containing compound.

22. A process according to claim 21 wherein the aftertreatment is effected at a temperature between room temperature and 80° C.

23. A process according to claim 22 wherein the aftertreatment is effected at a pH of 5 to 9.

24. A process according to claim 22 wherein the levelling/retarding agent is an ethoxylated fatty amine or polyamine or a quaternized ethoxylated fatty acid amido-amino in which the ethoxylated chain contains 5 to 200 ethyleneoxy units or a sulphate salt of a condensate of a fatty-amino-alkyl-amine or fatty-amido-alkyl-amine with 1 to 100 mols of ethylene oxide and 1 to 200 mols of propylene oxide.

25. A process according to claim 24 wherein the aftertreatment is effected at a pH of 5 to 9.

26. A process according to claim 25 wherein the cationic fixing agent is a condensation product of dicyanodiamide and formaldehyde in the presence of ammonium chloride.

27. An aqueous composition for after-treating wool dyeings comprising a cationic fixing agent, 40 to 60% by weight, based on the cationic fixing agent, of a cationic or amphoteric levelling/retarding agent having affinity for wool dyestuffs, together with at least 25% by weight, based on the total weight, of water.

28. A composition according to claim 27 wherein the cationic fixing agent is an addition salt of a condensation product of formaldehyde with an amino- or imino-group-containing compound and the levelling/retarding agent is an ethoxylated fatty amine or polyamine or a quaternized ethoxylated fatty acid amido-amine in which the ethoxylated chain contains 5 to 200 ethyleneoxy units or a sulphate salt of a condensate of a fatty-amino-alkyl-amine or fatty-amido-alkyl-amine with 1 to 100 mols of ethylene oxide and 1 to 200 mols of propylene oxide.

29. A composition according to claim 28 wherein the cationic fixing agent is a condensation product of dicyanodiamide and formaldehyde in the presence of ammonium chloride.

* * * * *